US011766858B2

(12) United States Patent
Barbet et al.

(10) Patent No.: US 11,766,858 B2
(45) Date of Patent: Sep. 26, 2023

(54) DROP FORMATION METHOD AND DEVICE USING A CAVITY WITH A DEGRADED QUALITY FACTOR

(71) Applicant: DOVER EUROPE SÀRL, Vernier (CH)

(72) Inventors: Bruno Barbet, Etoile-sur-Rhône (FR); Daniel Esteoulle, Toulaud (FR)

(73) Assignee: DOVER EUROPE SÀRL, Vernier (CH)

( * ) Notice: Subject to any disclaimer, the term of this patent is extended or adjusted under 35 U.S.C. 154(b) by 204 days.

(21) Appl. No.: 17/292,136

(22) PCT Filed: Nov. 14, 2019

(86) PCT No.: PCT/EP2019/081378
§ 371 (c)(1),
(2) Date: May 7, 2021

(87) PCT Pub. No.: WO2020/099586
PCT Pub. Date: May 22, 2020

(65) Prior Publication Data

US 2021/0394508 A1 Dec. 23, 2021

(30) Foreign Application Priority Data

Nov. 14, 2018 (FR) ..... 1860512

(51) Int. Cl.
*B41J 2/03* (2006.01)
*B41J 2/085* (2006.01)
(Continued)

(52) U.S. Cl.
CPC ..... *B41J 2/03* (2013.01); *B41J 2/085* (2013.01); *B41J 2/09* (2013.01); *B41J 2/17596* (2013.01); *B41J 2002/022* (2013.01)

(58) Field of Classification Search
CPC ..... B41J 2/085; B41J 2/03; B41J 2/09; B41J 2/17596; B41J 2002/022
See application file for complete search history.

(56) References Cited

U.S. PATENT DOCUMENTS 3,927,410 A 12/1975 Pimbley
4,146,899 A 3/1979 Paranjpe et al.
(Continued)

FOREIGN PATENT DOCUMENTS

CN 106457826 A 2/2017
CN 108215507 A 6/2018
(Continued)

OTHER PUBLICATIONS

Office action for Chine Patent Application No. 201980074937.4 dated May 7, 2022 and translation thereof.
(Continued)

*Primary Examiner* — An H Do
(74) *Attorney, Agent, or Firm* — Pearne & Gordon LLP

(57) ABSTRACT

A drop generator for a printing head of a continuous inkjet printer includes at least one ink feed conduit for feeding ink into a stimulation chamber, which has a quality factor Q lower than 2 and at least one resonant frequency $f_r$; an actuator for stimulating a wall of said stimulation chamber; and at least one nozzle for ejecting a jet.

20 Claims, 6 Drawing Sheets

(51) Int. Cl.

| | |
|---|---|
| ***B41J 2/09*** | (2006.01) |
| ***B41J 2/175*** | (2006.01) |
| ***B41J 2/02*** | (2006.01) |

(56) References Cited

U.S. PATENT DOCUMENTS

| | | | | |
|---|---|---|---|---|
| 5,530,606 | A * | 6/1996 | Baasch | G11B 5/4826 |
| 7,192,121 | B2 | 3/2007 | Barbet et al. | |
| 7,777,395 | B2 * | 8/2010 | Xu | B41J 2/03 310/326 |
| 9,028,024 | B2 * | 5/2015 | Barbet | B41J 2/115 347/73 |
| 10,286,652 | B2 * | 5/2019 | Bonneton | B41J 2/105 |
| 11,247,473 | B2 * | 2/2022 | Bonneton | B41J 2/105 |
| 2010/0045753 | A1 | 2/2010 | Barbet | |
| 2017/0028721 | A1 | 2/2017 | Barbet et al. | |
| 2018/0162121 | A1 | 6/2018 | Bonneton | |
| 2019/0248143 | A1 | 8/2019 | Barbet | |

FOREIGN PATENT DOCUMENTS

| | | | |
|---|---|---|---|
| EP | 0252593 | A2 | 1/1988 |
| FR | 2851495 | A1 | 8/2004 |
| FR | 2890596 | A1 | 3/2007 |
| WO | 2008045235 | A1 | 4/2008 |

OTHER PUBLICATIONS

International Search Report for PCT/EP2019/081378 dated Jan. 30, 2020.

Written Opinion for PCT/EP2019/081378 dated Jan. 30, 2020.

Search Report for French application No. FR1860512 dated Jul. 10, 2019.

Specification and drawings for U.S. Appl. No. 17/118,778, filed Dec. 10, 2020.

* cited by examiner

DROP FORMATION METHOD AND DEVICE USING A CAVITY WITH A DEGRADED QUALITY FACTOR

CROSS-REFERENCE TO RELATED APPLICATIONS

This is a National Stage of PCT international application PCT/EP2019/081378, filed on Nov. 14, 2019, which claims the priority of French Patent Application No. 1860512, filed Nov. 14, 2018, both of which are incorporated herein by reference in their entirety.

PRIOR ART

The invention relates to the field of printing heads for industrial inkjet printers, for example multi-jet printing heads of a continuous inkjet printer.

With some of these printing heads, for example that described in FR 2851495, it is attempted to form, from a jet, a "single" or individual drop, not accompanied with or not neighbouring other drops in a continuous jet. According to this document, the transfer function of the stimulation system is preferably free of resonance peaks in the pass band of the jet.

Another problem is to generate drops with a cut off, with respect to the jet it comes from, which would be sharp, in particular without resulting in generating parasitic drops.

Another problem is the size of the cavity for forming jets (or drops). The known printing heads have a cavity for forming jets (or drops) with a relatively limited size, for example 50 μm×100 μm×100 μm. The problem arises of manufacturing cavities for forming jets (or drops) with a higher size.

Another problem appears when it is desired, with a single cavity, to supply several jets of a same printing head.

Indeed, it is noticed that the activation of the stimulation means often generates a multitude of parasitic signals, as "rebounds" which create a cut-off resulting in generating parasitic drops and/or generating noise in one or more neighbouring cavities or in at least one portion neighbouring a single cavity supplying several jets.

Therefore, the problem arises of finding another method and another device for forming drops which enables one or more of these problems to be solved.

DISCLOSURE OF THE INVENTION

First, one object of the invention is a drop generator for a printing head of a continuous inkjet printer, including:

- at least one stimulation chamber, which has, at at least one resonant frequency $f_r$, a quality factor Q lower than 2; for example the resonant frequency $f_r$ is typically between 30 kHz (or 50 kHz) and 300 kHz;
- stimulation means (or actuator, for example piezoelectric means or a piezoelectric crystal), for stimulating a wall of said stimulation chamber;
- a nozzle for ejecting a jet.

At least one ink feed conduit may feed the ink into the stimulation chamber.

Preferably, the stimulation chamber, or a printing head which includes said stimulation chamber, is connected to pressurising means enabling, for at least one viscosity of the ink, for example between 1 cps and 10 cps or 10 cps (or even 20 cps), a jet having a cut-off frequency ($F_c$) higher than the resonant frequency $f_r$ of the cavity to be generated.

According to one embodiment, the generator includes a layer, for example of Kapton, which dampens the oscillations of the stimulation means transmitted to the cavity. This layer is disposed between the stimulation means of a wall and this wall.

According to another embodiment, at least one part of the stimulation chamber of the generator according to the invention is of annealed stainless steel. This is for example the wall which is provided with the stimulation means.

The stimulation signals, for example square shaped, can for example be separated by a time duration between, on the one hand, 5 μs or 10 μs and on the other hand 30 μs or even 40 μs.

The stimulation means can be able to apply to the stimulation chamber stimulation signals, the spectrum of which includes at least said resonant frequency $f_r$.

The stimulation chamber can have a length between 5 000 μm and 500 μm (for example measured in the ink flow direction in the chamber), a width (for example measured perpendicular to the ink flow direction in the chamber), between 2 000 μm and 200 μm and a thickness (measured along an axis parallel to the jet flow axis between 500 μm and 100 μm (or even 30 μm or 20 μm or 10 μm).

The stimulation chamber can have a volume between 10 $mm^3$ or 5 $mm^3$ and $10^{-2}$ $mm^3$ or $5\times10^{-3}$ $mm^3$ or $10^{-3}$ $mm^3$.

The invention also relates to a multi-jet printing head of a continuous inkjet printer including:

- a plurality of nozzles for forming jets, each nozzle being associated with a stimulation chamber according to the invention;
- means, for example at least one electrode, for deviating each jet;
- an outlet slot, open outwardly of the printing head and enabling the drops or ink segments for printing to flow out,
- a gutter for recovering the drops or segments which are not intended for printing.

In a multi-jet printing head, each nozzle can have its own stimulation chamber (and an ink volume coupled to the actuator). This assembly is repeated to form a jet or nozzle array. Each elementary unit has an operation which, in principle, is independent. It can have a quality factor Q lower than 2 to reduce or limit parasitic effects.

The invention also concerns a continuous inkjet printer including a printing head according to the invention, and further including control means programmed:

- to apply 2 successive cut-offs to a jet, for creating a drop isolated from the rest of the jet, this drop being preceded, or immediately preceded, by an ink segment not forming a drop and followed, or immediately followed, by another ink segment not forming a drop;
- and/or to apply 3 or more successive cut-offs to a jet, for creating a series of 2 or more drops, this series of drops being preceded, or immediately preceded, by an ink segment not forming a drop and followed, or immediately followed, by another ink segment not forming a drop.

The invention also concerns a method for forming one or several drops with a continuous inkjet printer forming an ink jet (for example a continuous inkjet printer including a printing head according to the invention), comprising:

- applying 2 successive cut-offs to the ink jet, thus creating a drop isolated from the rest of the jet, this drop being preceded, or immediately preceded, by an ink segment not forming a drop and followed, or immediately followed, by another ink segment not forming a drop;

and/or applying 3 or more successive cut-offs to the ink jet, for creating a series of 2 or more drops, this series of drops being preceded, or immediately preceded, by an ink segment not forming a drop and followed, or immediately followed, by another ink segment not forming a drop.

For example:

an ink segment for forming a drop can have a length of between 200 μm and 600 μm (measured along the flow axis or direction), an ink segment not forming a drop can have a length (also measured along the flow axis or direction) which is at least two times the length of an ink segment for forming; an ink segment not forming a drop can have a minimum length comprised, at least, between 400 μm and 1200 μm (but this is just a minimum, it can have a length longer than 1200 μm).

The invention also relates to a method for forming at least one individual drop using a multi-jet printing head such as that above, in which:

at least one jet, for example having a cut-off frequency higher than the resonant frequency $f_r$ of the cavity is produced, at least one activation signal, the spectrum of which includes at least said resonant frequency $f_r$, is applied to the stimulation means.

BRIEF DESCRIPTION OF THE DRAWINGS

Examples of embodiment of the invention will now be described in reference to the appended drawings in which.

In the figures, similar or identical technical elements are designated by the same reference numbers.

DETAILED DESCRIPTION OF EMBODIMENTS

A structure of a printing head to which the invention can be applied is explained below, in connection with FIG. 1.

This head comprises a drop generator 1. This generator includes a nozzle plate 2 on which an integer n (n>1) of nozzles $\mathbf{4}_x$, including a first nozzle $\mathbf{4}_1$ and a last nozzle $\mathbf{4}_n$, is aligned along an axis X (contained in the plane of the figure). For example $1 \leq n \leq 128$, in particular n can be equal to 32 or 64.

The first and last nozzles ($\mathbf{4}_1$, $\mathbf{4}_n$) are the nozzles farthest from each other.

Each nozzle has an emission axis of a jet parallel to a direction or an axis Z (located in the plane of FIG. 1), perpendicular to the nozzle plate and to the previously mentioned axis X. A third axis, Y, is perpendicular to each of both axes X and Z, both axes X and Z extending in the plane of FIG. 1.

Each nozzle is in hydraulic communication with a pressurised stimulation chamber. The drop generator includes as many stimulation chambers as nozzles. Each chamber is equipped with an actuator, for example a piezoelectric crystal. Examples of design of a stimulation chamber are described below.

Downstream of the nozzle plate, there are means, or sorting block, 6 (including one or more electrodes) which enable drops for printing drops or jet segments which are not used for printing to be separated. This separation can be made without drop charging, as explained in document FR2851495. In other words, the cavity does not contain electrodes for charging the ink drops or segments. This block has, along the jet flow axis Z in the cavity, a height h. h can be in the order of a few millimetres, for example between 2 and 10 mm, still for example 4 mm.

Figure 1:
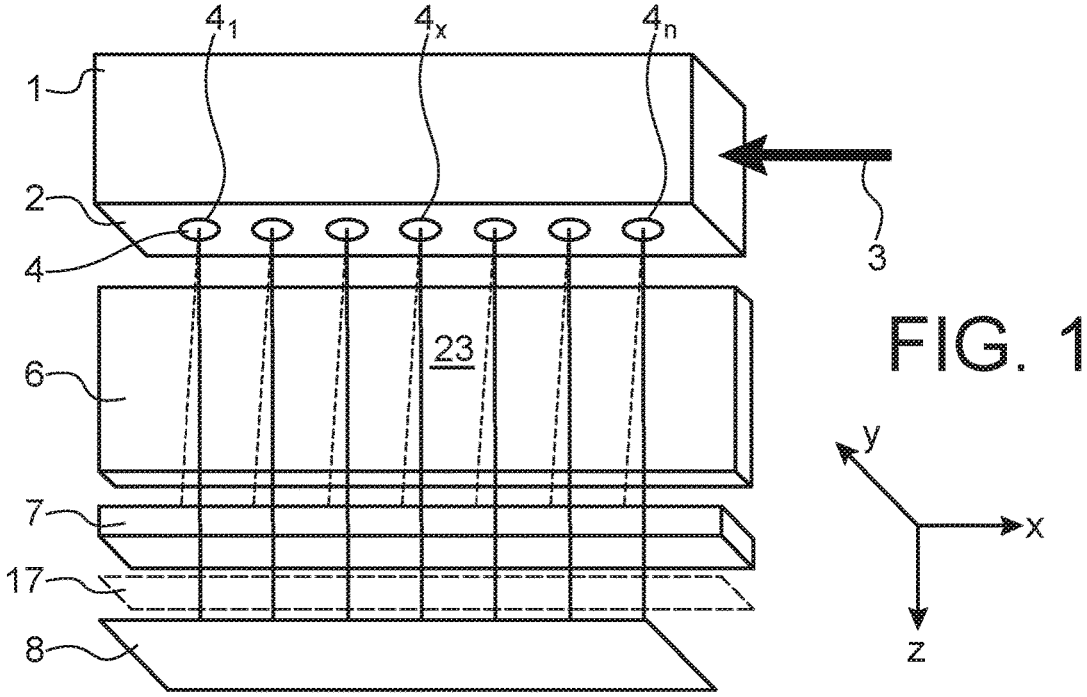
FIG. 1 represents a schematic isometric view of a printing head mainly showing the components of the printing head located downstream of the nozzles.

The device of FIG. 1 enables in particular a continuous jet to be deflected through localised charges, while not charging the entire jet. The latter remains neutral in the influence zone of the means 6 while separating positive charges from negative charges. The means 6 can include any combination of electrodes (size, potential, distribution, number) enabling both conditions to be fulfilled.

The emitted drops or the jet segments, emitted by a nozzle and intended for printing follow a trajectory along the nozzle axis Z and hit a printing medium 8, after passing through an outlet slot 17. This slot is open to the outside of the cavity and enables ink drops for printing to flow out; it is parallel to the nozzle alignment direction X, the nozzle direction axes Z passing through this slot, which is located on the face opposite to the nozzle plate 2. It has, along the direction X, a length at least equal to the distance between the first and the last nozzle.

The space zone in which the ink circulates between the nozzle plate 2 and the outlet slot 17 for the drops for printing or between the nozzle plate and the gutter is also called the head "cavity". The nozzle plate 2 actually forms an upper wall for the cavity.

The emitted drops or the jet segments, emitted by a nozzle and not intended for printing, are deviated by the means 6 and are recovered by a gutter 7 and then recycled. The trough has, in the direction X, a length at least equal to the distance between the first and the last nozzle.

Figure 2A:
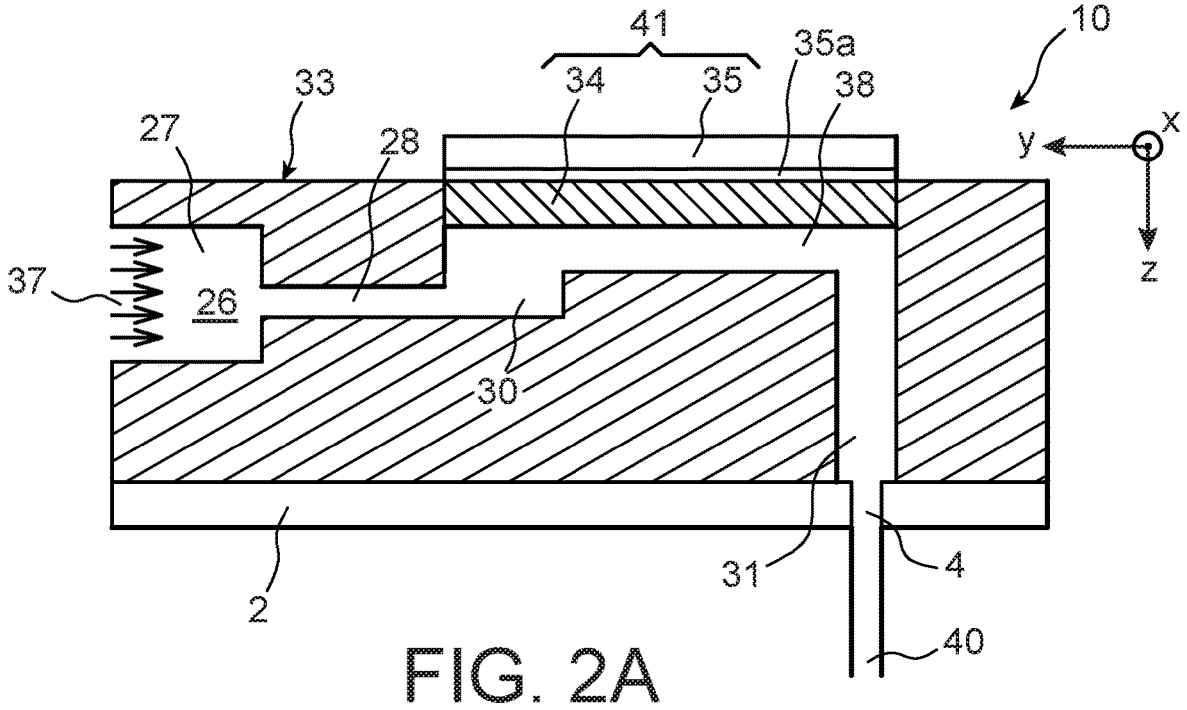
FIGS. 2A and 2B represent as a cross-section, drop generators, to which the invention can be applied.

An example of a cavity of a drop generator according to the invention is illustrated as a cross-section in FIG. 2A; Z is the direction of the jets 40 and Y a direction perpendicular to Z located in a plane perpendicular to the plane containing the axes of the nozzles 4.

The hydraulic path inside the body 33 of the generator, includes from upstream to downstream:

a tank 27; it is intended for containing ink 26, which is pressurised when the device is in use; this tank 27 can be communicated (see arrows 37) with an ink feed circuit, not represented, and with a narrow passage 28 (restriction);

a first connecting tube 30, which communicates the restriction 28 with the stimulation chamber 38, itself in communication with the nozzle 4 for forming the jet 40 through a second connecting tube (or column) 31; in use, the pressure of the ink provided to the chamber 38 is for example between 1 bar and 12 bar for a viscosity for example between 3 and 20 cps or even 30 cps (for example for T=20° C. and P=3 bar);

the nozzle 4, pierced in a nozzle plate 2 which can include several nozzles aligned along the direction Y perpendicular to the plane XZ.

The column 31 enables an accurate jet directivity to be ensured, which promotes a proper operation in a multi-jet device.

A wall part of the chamber 38 is formed by a membrane 34 the thickness of which, along the axis Z, is much lower than its dimensions in the plane X,Y. In the outer face of the membrane 34, external to the chamber 38, an actuator which can be a piezoelectric element (typically: a ceramic) 35 is bonded, which can be connected to voltage supply means (for example a voltage generator) (not represented in the figure) providing voltages for activating the element 35 in the order of a few tens of volts, for example between 5V and 50V.

Without the layer 35*a* (the function of which is explained below) when an electric signal is applied to the piezoelectric element 35, the membrane 34/piezoelectric element 35 couple forms a vibratory element 41 which is flexurally deformed, resulting in producing a volume and pressure modulation in the chamber 38; this results in a modulation in the mean ejection velocity of the ink 26 at the nozzle 4. $f_r$ designates the resonant frequency of the mechanical cavity 10 and of its fluidic structure (including the coupling with the actuator 35); $f_r$ is for example between 50 kHz and 300 kHz.

Figure 2B:
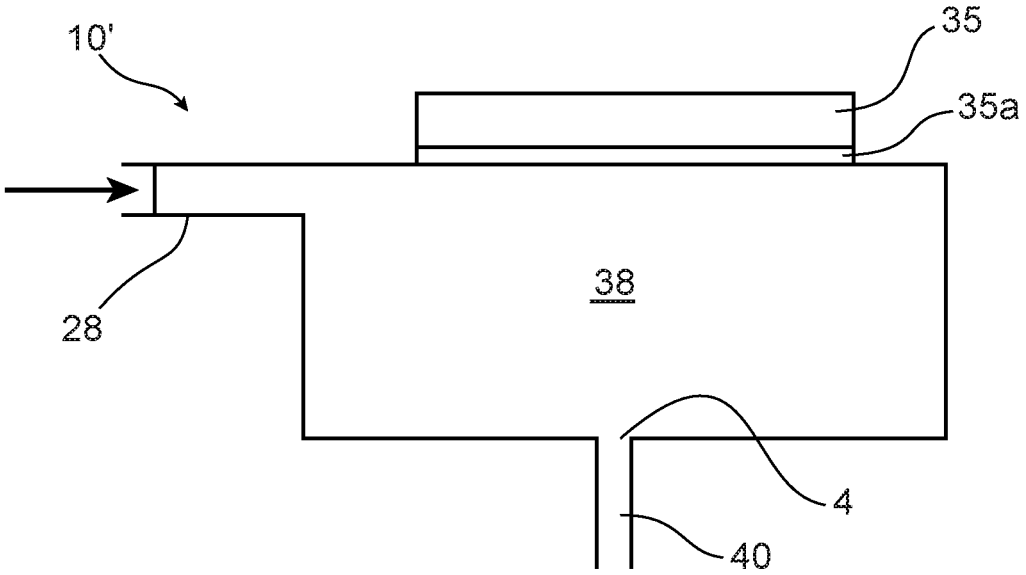

The invention can also be applied to a simpler cavity structure 10', as represented in FIG. 2B, in which the stimulation chamber 38 is in direct communication with the nozzle(s) 4. Reference numerals identical to those of FIG. 2A designate the same elements therein.

The quality factor Q of a cavity at a resonant frequency $f_r$ of said cavity is given by the ratio between the resonant frequency $f_r$ and the full width at half maximum of the frequency peak at the resonant frequency $f_r$; see for example «Dynamique générale des vibrations», Yves Rocard, Professeur à la Faculté des Sciences de Paris, 1960, Editions Masson et Cie, pages 12 à 21, Chapitre 2. See also the following Wikipedia page:

https://fr.wikipedia.org/wiki/Syst%C3%A8me_oscillant_%C3%A0_un_degr%C3%A9_de_libert%C3%A9 concerning "système oscillant à un degré de liberté".

According to an aspect of the present invention, means which enable the quality factor Q of the cavity 10 to be reduced at a value lower than 2, or even lower than 1, preferably higher than or equal to 0.5 or $10^{-1}$ can be further provided. It is reminded that, generally, a very good quality factor is intended, this is in the order of 10 for CIJ type printing heads (which operate in a harmonic steady state; Q enabling the supply voltage for the element 35 to be minimised by taking advantage of the amplification related to the resonance effect). On the contrary, according to the present invention, it is attempted to reduce the quality factor, preferably within the limits indicated above.

Here, according to one embodiment, these means include a layer of a material 35*a*, for example of Kapton, which are disposed between the membrane 34 and the piezoelectric element 35 and enabling the stimulation induced by the means 35 to be dampened.

Alternatively, other means for reducing the quality factor Q can be implemented, for example by modifying the dimensions of the cavity 38 to increase ink viscous frictions in the same and/or by using a material (for example for the membrane 34), such as annealed stainless steel, which dampens more than stainless steel itself.

Figure 3:
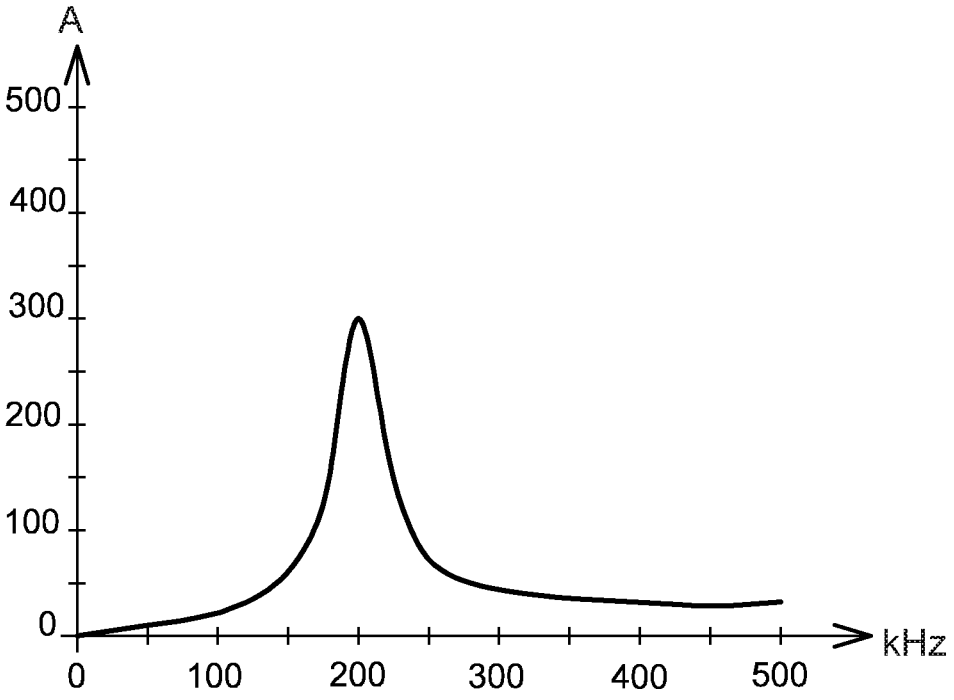
FIG. 3 represents an example of a transfer function of the cavity of the previous figure, with its resonance peak.

The quality factor Q can be obtained or measured from the transfer function, or admittance curve (FIG. 3) as a function of the excitation frequency f of the system; in the example given, this is the frequency of the voltage signal applied to the piezoelectric actuator 35 of FIG. 2A or 2B; admittance is the inverse of impedance, itself equal to the ratio V/I, with I=current (delivered by the voltage supply means) and V=voltage applied to the means 35, which is substantially constant. This curve can be obtained with a device called a transferometer. At the resonant frequency $f_r$, Q depends on the full width at half maximum of the frequency peak (about the resonant frequency $f_r$). Examples of admittance curves measured in the air, in the solvent and in the ink are given in FIG. 5.

Figure 4A:
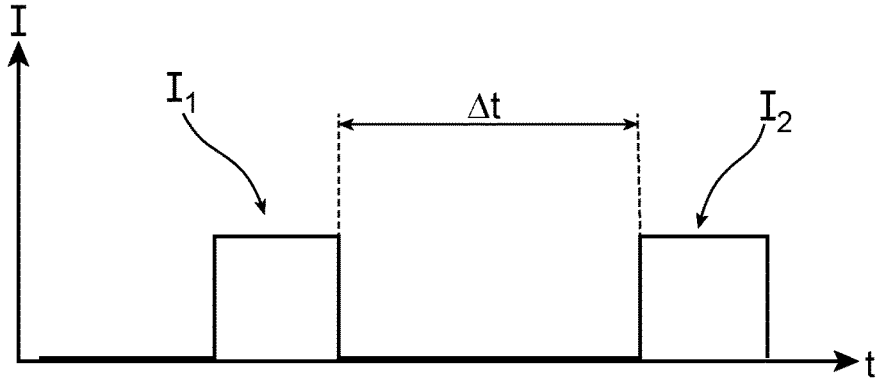
FIGS. 4A-4C represent various time and frequency charts, which enable the implementation of a method according to the invention to be explained.
Figure 4B:
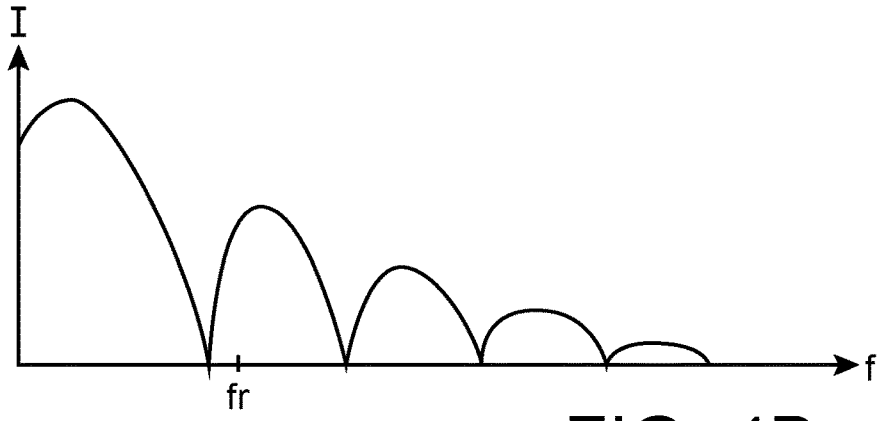
Figure 4C:
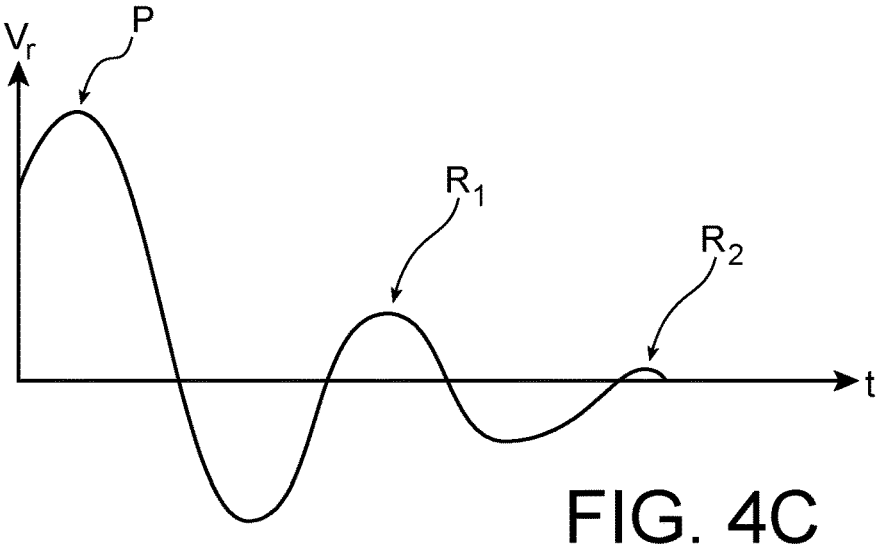

FIGS. 4A-4C represent an example of method that can be implemented to generate a single (or individual) drop using a cavity such as that of FIG. 2A or 2B:

pulses $I_1$, $I_2$, . . . are applied to the means 35, preferably square shaped (FIG. 4A), the pulses being for example separated by a time duration Δt between 10 μs and 30 μs. There can be pulses having a square shape, as in FIG. 4A, but, alternatively, each pulse can have a different or more complex shape, for example the shape of a trapezium, or a triangle, or sinusoid arch, but these other shapes have less energy than the squares of FIG. 4A. Each drop is formed by 2 successive jet breaks (each break corresponding to one of the 2 squares of FIG. 4A).

The so-called break point is located, with respect to the nozzle plate 2, at a distance which is for example of about 1 mm (or more generally between 0.5 mm and 3 mm).

This distance can vary, as a function of parameters such as jet diameter, jet velocity, ink viscosity, and stimulation efficiency (the latter being measured by the intensity of the pulse applied to the means 35, 41), this intensity being for example in the order of 20V, or more generally between 10V and 50V); from the frequency point of view, each pulse has the shape illustrated in FIG. 4B: it has a succession of positive sinusoid arches (sinc function (sin x)/x), including a succession of peaks the maximum intensity of which is decreasing.

For each of the pulses of FIG. 4A, the modulation in the average jet ejection velocity as a function of time t will have the aspect represented in FIG. 4C, in which a main peak P (or main modulation in the average ejection velocity) is seen followed by rebounds (secondary peaks) $R_1$, $R_2$, which correspond to secondary modulations in the average ejection velocity and which can be more or less dampened with respect to the peak P (actually, these secondary peaks reflect the dampening of the element 35, (coupled to the stimulation chamber), following each pulse applied). This dampening can be more or less marked, with secondary peaks $R'_1$, $R'_2$ more or less important with respect to the main peak P.

As explained above, drops, or individual drops are formed, for example within the scope of printing heads of the type described above in connection with FIGS. 1 and 7, by adjusting the time duration Δt which separates 2 pulses $I_1$, $I_2$. These drops are formed on top of the set of electrode(s) 6 or 14*a*-14*b* (or before arriving, along the axis Z, in front of this set), by choosing time instants for applying the pulses $I_1$, $I_2$. Each of the non-charged drops has a size lower than the total height h (the drop volume is calculated as follows: jet cross-section x jet velocity x time Δt: this product determining the volume of the jet cylinder which is deformed in a sphere, i.e. the printed drop) of the set of electrode(s) 6 or 14*a*-14*b* and which will not be thereby deviated by the action of this set when it will be in front of the same.

However, if a drop is formed in front of this set of electrode(s), it includes a charge and is deviated; indeed, the charge of the drop in question is not controlled if the potential on the electrodes is variable as a function of time; the drop deviation thus generally results in polluting the printing head because it is in an intermediate position between the trajectory directed to the trough (case where it will be properly recovered) and the printing trajectory (case where it would be properly printed), whereas it is conversely desired that it is printed, thus directed to the printing medium without deviation.

Because the quality factor Q<1 or 2, for each of the pulses of FIG. 4A, the jet velocity modulation as a function of time t will have the aspect represented in FIG. 4C, in which a strong dampening of the rebounds $R_1$, $R_2$, undergone after the main peak P, can be seen. This quality factor Q<1 or 2 limits the amplitude of these rebounds.

This double jet velocity modulation will enable a single (or individual) drop from the jet segment, isolated by the 2 breaks caused by each of the electric pulses (square) to be created, without parasitic drop following this single drop: the reduction (obtained by Q<1 or 2) in the intensity of the rebounds $R_1$, $R_2$ enables parasitic drops which could be produced on the inkjet to be removed, in the continuity of the single drop.

The scheme of FIG. 4C corresponds to a single pulse 11 (FIG. 4A) which produces the velocity modulation of a strong amplitude P (FIG. 4C) associated with a first jet break. The rebounds R1, R2, . . . Rn, of a smaller amplitude, do not disturb much the second modulation P (not visible in FIG. 4C, but identical or similar to the modulation P represented) created by 12. Thanks to the small quality factor of the device 10, the formation of the parasitic drops by the rebounds R1, R2 . . . associated with 12 is prevented.

Only one drop is formed by the pulses of FIG. 4A; however, forming 3 pulses, 2 successive pulses being separated by a time duration Δt (for example a time duration Δt between 10 μs and 30 μs), forms 2 drops, with the above mentioned advantage, namely avoiding the formation of parasitic drops by the rebounds associated with each pulse.

According to an aspect of the present invention, a jet 40 has a pass band which is located below the frequency $F_c$ (characteristic to the jet), called the cut-off frequency, defined by the relationship: $k_c=2\pi\ RF/V_j$ (1).

In this relationship, R represents the nozzle radius, whereas $V_j$ is the jet velocity; $k_c$ is a dimensionless number (or wave number at the capillary instability limit, according to Rayleigh's theory) which takes account in particular of the ink characteristics and nozzle diameter. The cut-off frequency is determined for a factor $k_c$ of 1. The velocity $V_j$ is generally between 10 and 20 m/s (for example: 14 m/s).

According to one aspect of the invention, the cavity and/or its ink supply means can be dimensioned such that its resonant frequency $f_r$ is located in the pass band of the jet; in other words: $f_r<F_c$. The elements of the device 10 of FIG. 2A (or FIG. 2B) behave from the vibratory point of view as elements of the RLC type in electrical analogy; but any RLC connection includes a resonant frequency which depends on the parameters R (loss factor), L (inertia) and C (elasticity). The part to be quantified herein is the factor R, the value of which is experimentally refined by measuring the transfer function, or admittance curve, mentioned above.

A dimensioning can result from the choice of the ink pumping means, which will enable the cavity to be supplied with an ink, having some viscosity, for example between 1 cps and 20 cps, so as to fulfil the relationship: $f_r<F_c$.

Each of the drops formed has a diameter of a few tens of micrometres, for example between 20 μm and 70 μm, still for example about 50 μm; the diameter of each drop, which can be varied, is for example of about twice the jet diameter at the outlet of the corresponding nozzle. The volume of each drop can be estimated as the cross-section area of the nozzle ($\pi R^2$) x length of the jet segment ($V_j \times \Delta t$).

Figure 6:
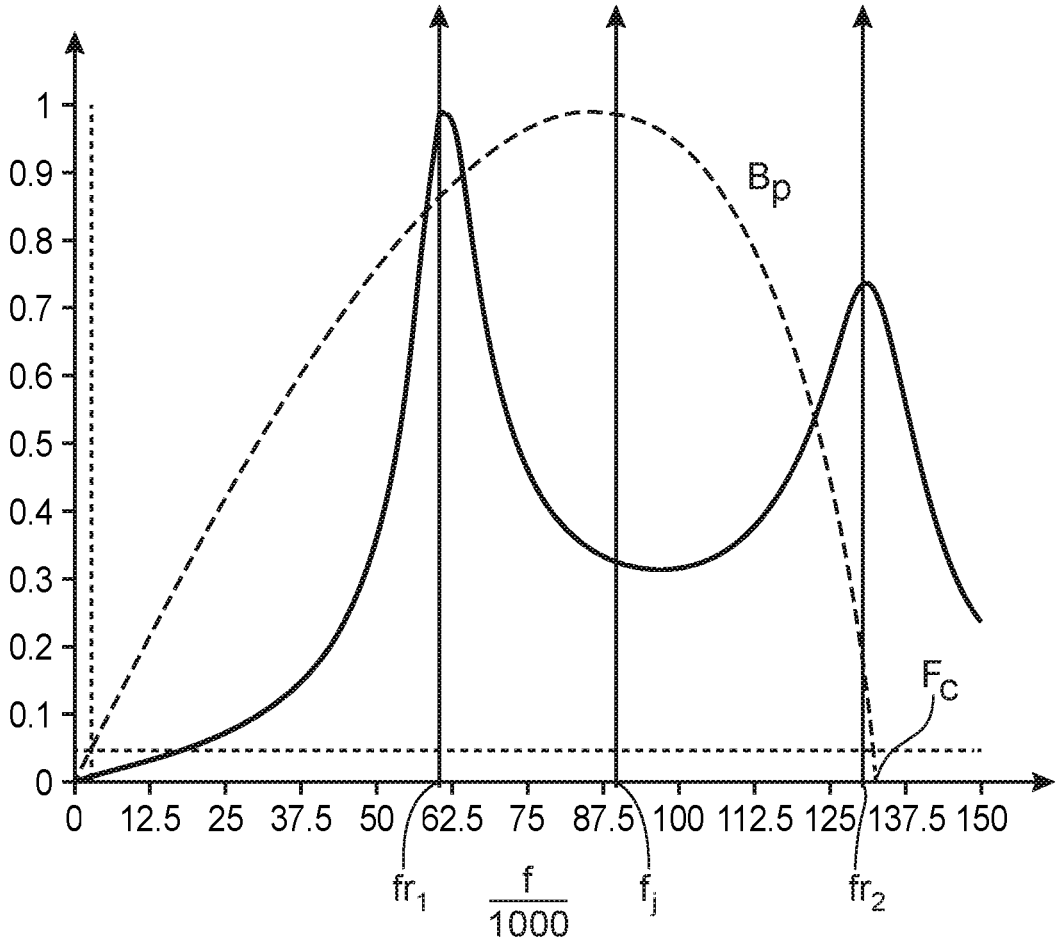
FIG. 6 represents the pass band of a jet, resonances of the cavity, and the resonant frequency of the jet.

The diameter of each drop is preferably lower than the extension along the axis Z, of the deviation means 6 (FIG. 1) or 14*a*, 14*b* (FIG. 6). The time duration Δt (of a separation between two successive pulses, FIG. 4A) can also be chosen such that the drop is fully in front of these deviation means 6 (in which case the drop is not deflected; an ink segment is deflected if it is of an extension, along the axis Z, higher than the deviation means 6).

The invention is quite compatible with printing on a medium located at a distance from the outlet slot 17 higher than 10 mm, for example equal to 30 mm and/or a medium which is transported, with respect to the printing head, with a velocity which can be higher than 10 or 15 m/s and/or lower than 20 m/s.

What is described above in connection with a single jet can be implemented for each of the jets produced by the printing head.

Each of the individual drops formed by a method or a device according to the invention is directed to the outlet slot 17 and can be printed on the printing medium 8 (FIGS. 1, 6).

Between 2 drops for being printed on the printing medium 5, a segment such as the segment 40 represented in FIG. 6 can be formed: this segment is not for printing and will be deviated into the gutter 7. As already explained above, it is also possible to form a series of 2 (or n, n>2) successive drops not separated by a segment such as the segment 40 represented in FIG. 6, this series of drops being preceded and followed by a segment such as the segment 40 represented in FIG. 6 (this segment not being for printing and being deviated into the gutter 7).

Figure 5:
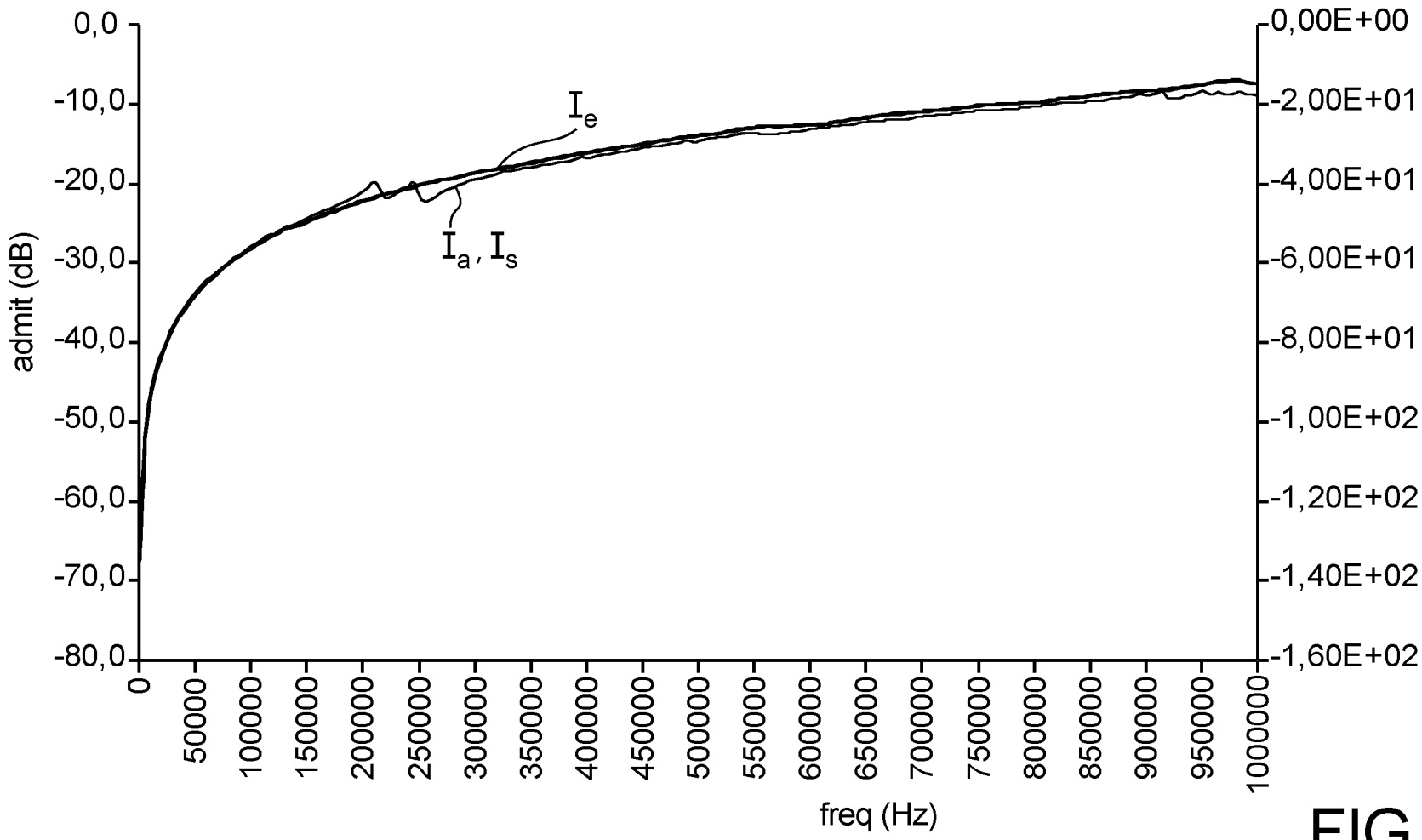
FIG. 5 represents examples of admittance measurements, in the air and in the ink.

FIG. 5 represents admittance measurements, in the air (the cavity 10 is free of ink), in solvent (the cavity 10 consequently contains solvent, with a viscosity of 1 cps) and finally in ink (the cavity 10 containing ink, with a viscosity of 6 cps).

The curves $I_a$, $I_s$ and $I_e$ respectively represent measurements made in the air, in solvent and in ink. In the curve $I_a$, a resonance at 250 kHz is clearly seen. The curve $I_s$ also includes this resonance, but this curve is superimposed with that of the measurements in the air. For the curve $I_e$, the resonance is fully dampened (because of the viscous losses). These various curves show the possibility to identify the resonant frequencies by admittance measurements in the air or in solvent.

Moreover, as previously explained, it is possible to adapt the quality factor by optimising dimensioning.

FIG. 6 represents, in dashed lines, the pass band of a jet (curve $B_p$) as a function of the frequency; the resonant frequency of the jet ($f_j$) corresponds to the maximum of this curve. 2 resonant frequencies of the cavity ($fr_1$ and $fr_2$) are also identified. Generally, in the present invention, when there are 2 or more resonant frequencies of the cavity, it is preferred to select the one closest to the maximum of the pass band curve $B_p$: the condition Q<2 is preferably evaluated at this closest frequency.

The curve $B_p$ is related to the course of the break rate; it is reminded that $L_b$, the break length, is equal to:

$$L_b = V_j \times T_b,$$

where $T_b$ is the break time, itself given by:

$$((\rho \times R^3/\sigma)/\gamma) \times \mathrm{Ln}(R/\varepsilon_0), \text{ where:}$$

σ=jet surface tension;
ρ=ink density;
R=initial jet radius (at the outlet of the nozzle);
$\varepsilon_0$=radius disturbances at the outlet of the nozzle;
γ=jet growth rate.

For a high growth rate, there are a short break time Tb and a break length $L_b$ which is short.

This curve thus shows at least one resonance of the cavity which is lower than the cut-off frequency.

This curve is obtained with the following dimensions of the cavity (the structure of which is that of FIG. 2A):

R=24 μm;
nozzle length=50 μm;
H (height of the stimulation chamber 38)=50 μm;
length of the chamber 38=3000 μm;
width of the chamber 38=600 μm;
diameter of the column 31: 200 μm;
length of the column 31: 1450 μm;
thickness of the diaphragm 35=50 μm.

In addition, the ink used has a viscosity of 3.5 mPa·S.

A cavity according to the invention, with a relatively small volume (in particular the volumes mentioned below), is advantageous for the following reasons.

A drop generator can be modelled, very schematically, by:

- a mechanical actuator based on a piezoelectric element coupled to a metal bar (of stainless steel for example). The assembly has a resonant frequency f1. This device is active because it is driven by the control voltage of the piezoelectric element;
- a volume of ink for flowing through the nozzle. The assembly thus makes up a resonant device by considering the fluid compressibility of the resonant frequency f2. This device is passive.

Both devices are in contact with each other (generally, the actuator is in the ink volume which results in modulating the fluid ejection velocity through the nozzle). Both actuators are coupled with a "complex" oscillatory behaviour. The particular case of f1≅f2 makes the system very difficult to control (because the resonances are "stacked").

One solution according to the present invention implements a reduced ink volume, such that it can be considered as incompressible at the working frequency.

If a mechanical (mass-spring) or electrical (inductor-capacitor) analogy is considered, the nozzle can be modelled by an impedance (inertia effect):

$$L = \rho \frac{l}{s}$$

(where ρ is the ink density, l the nozzle length and s the nozzle cross-section area).

The ink is modelled by an impedance (elastic effect):

$$C = \frac{V}{Ke}$$

(where Ke is the ink compression module and V the ink volume compressed by the mechanical actuator).

The incompressibility condition moves away f2 to the high frequencies and thus reduces the ink volume agitated by the actuator.

Whatever the embodiment, a cavity according to the invention, with a quality factor lower than 1 or 2, also enables multiple "rebounds", sources of noise, to the neighbouring portions of the cavity which supply other jets. Indeed, as explained above in connection with FIGS. 4A-4C, the small quality factor will enable successive rebounds $R_1$, $R_2$, which occur after the main peak P, to be dampened. The noise transmitted to the neighbouring portions of the cavity will thus be also dampened.

Another advantage of the invention is the following one: the implementation of a small quality factor enables a cavity with a size higher than known cavities to be made. In particular, it is possible to make a cavity with a length of 3000 μm, a width of 600 μm, a thickness of 50 μm whereas known cavities have dimensions in the order of 50 μm×100 μm×100 μm.

The aforementioned dimensions (3000 μm×600 μm×50 μm) for the stimulation chamber are for indicating purposes. There can also be, for example:

- a length between 6000 μm or 5000 μm and 1000 μm, or even 500 μm;
- a width between 2500 μm or 2000 μm and 500 μm or even 200 μm;
- a thickness between 600 μm or 500 μm and 100 μm or even 30 μm or 20 μm or 10 μm.

Such dimensions allow the cavity to be large enough for a better pump efficiency without having resonance frequencies close to the length of the acoustic waves inside the ink. Larger cavities are also easier to manufacture than smaller cavities. The above ranges allow a good compromise between these different requirements.

The stimulation chamber can have a volume between 10 $mm^3$ or 5 $mm^3$ and $10^{-2}$ $mm^3$ or $5\times10^{-3}$ $mm^3$ or $10^{-3}$ $mm^3$.

In the example of FIG. 2A, as regards the column 31, there can for example be:

- a diameter between 500 μm and 100 μm;
- a length between 500 μm and 2500 μm.

The material to make a structure according to the invention is for example stainless steel, but other metals, or ceramic, or glass or silicon can be used.

The invention can be applied to a printing head such as that of FIG. 1.

Figure 7:
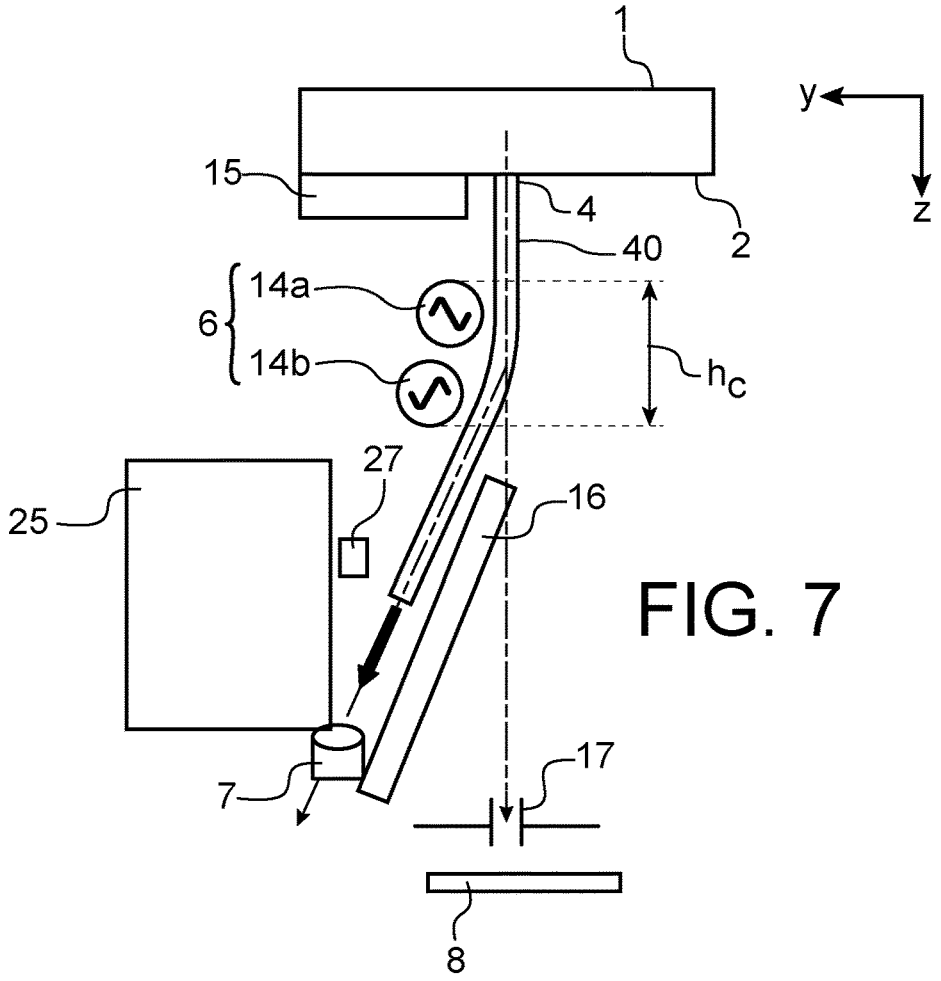
FIG. 7 represents a schematic view of a cavity of a printing head to which the invention can be applied.

FIG. 7 represents another printing head to which the invention can be applied.

This figure is a cross-section view made along a plane parallel to the plane YZ, and containing the axis Z of a nozzle 4. The printing head here includes, as in the case of FIG. 1, a set of n nozzles (n>1), aligned along an axis X (perpendicular to the plane of FIG. 7). The representation of each cross-section keeps the same shape over the distance from the first nozzle $\mathbf{4}_1$ to the last nozzle $\mathbf{4}_n$ along the direction X (perpendicular to the plane of FIG. 6).

In this printing head, the drop generator according to the invention can be equipped with a shielding electrode 15. In use, this electrode can be brought to the same potential as ink. Drops, which are broken in front of this electrode are not electrically charged, consequently they are neutral.

The printing head is also provided with a set 6 of two electrodes 14*a*, 14*b*, disposed along the path of a jet 40 produced by the generator 1. The 2 electrodes are preferably substantially at the same distance from the hydraulic trajectory defined by the axis of a non-deviated jet flowing out of the nozzle 4; the influence zone of the electrodes 14*a*, 14*b* extends to the jet 40, on a short distance.

During a print job, such a head operates the following way.

The 2 electrodes 14*a*, 14*b* enable a variable electric field E to be generated, to which the jet 40 is subjected; to do this, they are thereby supplied with variable potentials.

In particular, according to one embodiment, the electrodes can be supplied such that the time average of the electric field E is null, or almost null or low (each electrode can be supplied by a variable high voltage signal, with a given amplitude Vo, a frequency F and an identical shape but having a 180° phase shift between each other). Thus, the jet 40 is electrically neutral in the influence zone of the electrodes 14*a*, 14*b*; however, the positive and negative charges distributed in the jet 40 by the electrodes are separated (an electric dipole is thus induced in the jet) so that a deflection can be ensured (more exactly: under the action of the forces created by both electrodes 14*a*, 14*b*, the jet 40 is deviated from its hydraulic trajectory and tends to move closer to the electrodes 14*a*, 14*b*). Thus, at any time, the positive sign charge amount induced on the jet 40 by the electrode supplied with a negative signal is almost equal to the negative sign charge amount induced on the jet 40 by the electrode supplied by a positive signal (the jet remains with a null average charge). Therefore, there is little or no electric charge circulation on large distances in the jet 40, in particular between the nozzle 4 and the electric influence zone of the electrodes.

In a favoured implementation, the 2 electrodes have a same geometry (they can be of an identical dimension h along the axis Z, separated by an electrical insulator), and, during a print job, the electric signals for each electrode are of identical amplitude, frequency and shape but they are phase shifted (in phase opposition for the couple of electrodes).

The device of FIG. 7 thus allows a deflection of a continuous jet 40 to be obtained through localised charges, while not charging the entire jet. The latter remains neutral in the influence zone of the electrodes 14*a*, 14*b* while separating positive charges from negative charges. Any other combination of electrodes (size, potential, distribution, number) enabling both conditions to be fulfilled verifies this principle. An example is illustrated in FIG. 2B of FR 2906755 (not reproduced here), in which the set of electrodes comprises alternating electrodes brought to the same potential with electrodes brought to the reverse potential; the electrodes are separated by insulators, preferably with identical dimensions and nature to each other.

Alternatively, all the other structures of electrodes exhibited in document FR 2906755 can be implemented, as well as the aspects relating to the implementation of the different solutions. In particular, the length of the so-called deflected jet segments not used for printing is preferably higher than or equal to the total height $h_c$ of the array of electrodes 14*a*-14*b* (measured along the axis Z, see FIG. 6; $h_c$ can be in the order of a few millimetres, for example between 2 and 10 mm, still for example 4 mm).

The invention enables individual drops, with a size lower than the total height $h_c$ of the array of electrodes 14*a*-14*b* to be produced, and which will not be thus deviated by the action thereof. In particular, the time duration Δt which separates 2 pulses $I_1$, $I_2$ can be adjusted, such that the drops formed are fully in front of the set of the electrodes 14*a*-14*b*.

Another printing head to which the invention can be applied is that described in document FR 2851495; it includes a charging electrode, and a deflection electrode.

A device according to the invention is supplied with ink through an ink tank not represented in the figures. Various fluid connection means can be implemented to connect this tank to a printing head according to the invention, and to recover the ink that comes from the gutter. An example of a full circuit is described in U.S. Pat. No. 7,192,121 and can be used in combination with the present invention.

Whatever the embodiment contemplated, the instructions, to activate the means 35 for producing ink jets and/or the trough pumping means, are sent by control means (also called a "controller"). These are also the instructions that will enable pressurised ink to be circulated toward the drop generators, and then jets to be generate depending on the patterns to be printed on a medium 8. These control means are for example made as an electrical or electronic circuit or a processor or a microprocessor, programmed to implement a method according to the invention.

It is this controller that drives the means 35 for producing one or more ink and/or solvent jets, and/or the pumping means of the printer, and in particular the trough, and/or opening and closing valves on the travel path of the different fluids (ink, solvent, gas).

This controller, or these control means, can also provide the storage of data and a possible processing thereof.

This controller, or these control means, include the instructions to implement a method according to the present invention and/or to control drop formation according to the present invention.

Regardless of the embodiment of a device or a method according to the invention, means are provided to apply the necessary voltages to the various electrodes, for example to the electrode(s) forming the means 6 or 14*a*, 14*b*. It can be for example one or more voltage sources driven by the controller forming means of the printer.

Figure 8:
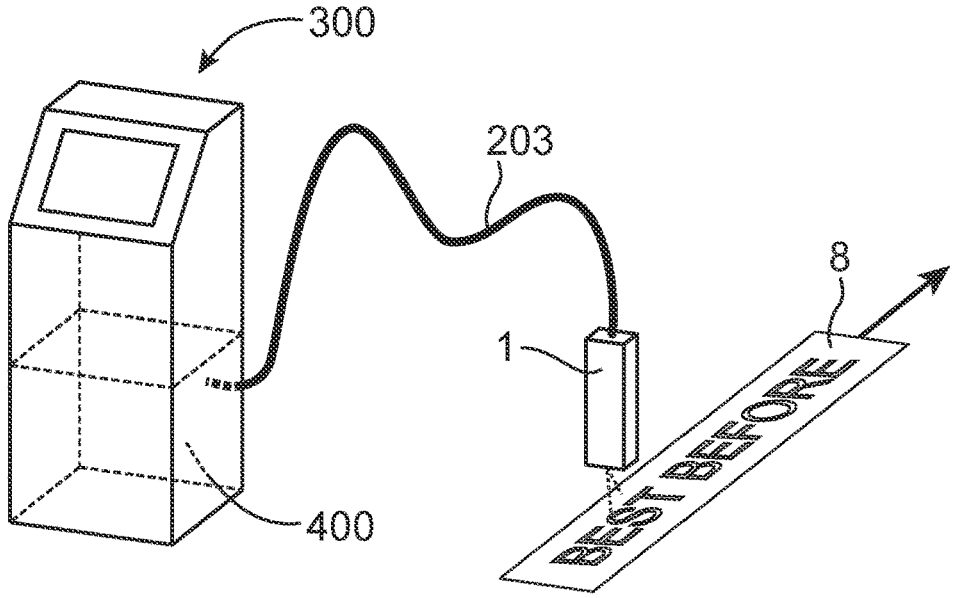
FIG. 8 represents the main blocks of an inkjet printer that can implement the invention.

In FIG. 8, the main blocks of an inkjet printer which can implement one or more of the embodiments described above have been represented. The printer includes a console 300, a compartment 400 containing in particular the circuits for conditioning the ink and solvents, as well as tanks for the ink and solvents (in particular, the tank to which the ink recovered by the trough is brought back). Generally, the compartment 400 is in the lower part of the console. The upper part of the console includes command and control electronics as well as viewing means. The console is hydraulically and electrically connected to a printing head 100 through an umbilical 203.

A gantry, not represented, enables the printing head to be installed in front of a printing medium 8, which is moved along a direction symbolised by an arrow. This direction is perpendicular to a nozzle alignment axis.

What is claimed is:

1. A drop generator for a printing head of a continuous inkjet printer, including:

at least one ink feed conduit for feeding ink into a stimulation chamber, which has a quality factor Q lower than 2 and at least one resonant frequency $f_r$, wherein the quality factor is a ratio of the resonant frequency $f_r$, to a full width half maximum of a frequency peak of the resonant frequency $f_r$, an actuator for stimulating a wall of said stimulation chamber; and at least one nozzle for ejecting a jet.

2. The drop generator according to claim 1, including a layer which dampens the oscillations of the actuator transmitted to the cavity.

3. The drop generator according to claim 2, said layer, which dampens oscillations, being of Kapton.

4. The drop generator according to claim 1, at least one part of the cavity being of annealed stainless steel.

5. The drop generator according to claim 1, said actuator being able to apply to said stimulation chamber stimulation signals separated by a time duration between 5μs and 40μs.

6. The drop generator according to claim 1, said actuator being able to apply to said stimulation chamber stimulation signals, the spectrum of which includes at least said resonant frequency $f_r$.

7. The drop generator according to claim 1, said resonant frequency $f_r$ being between 50kHz and 300kHz.

8. The drop generator according to claim 1, said stimulation chamber having:

a length between 6000 μm and 500 μm;

a width between 2500 μm and 200 μm;

a thickness between 600 μm and 10 μm.

9. The drop generator according to claim 1, said stimulation chamber having a volume between 10 $mm^3$ and 10−3 $mm^3$.

10. A multi-jet printing head of a continuous inkjet printer including:

a plurality of nozzles for forming jets, each nozzle being associated with a drop generator according to claim 1;

at least one electrode for deviating each jet;

an outlet slot, open outwardly of the printing head and enabling the drops or ink segments for printing to flow out;

a gutter for recovering the drops or segments which are not intended for printing.

11. The printing head according to claim 10, further including at least one pump allowing, for at least one ink viscosity between 1 cps and 20cps, a jet velocity, said jet having a pass band, the cut-off frequency ($F_c$) of which is higher than the resonant frequency $f_r$.

12. A continuous inkjet printer including the printing head according to claim 10, and further including a controller programmed to apply at least 2 successive cut-offs to a jet, for creating at least one drop isolated from the rest of the jet, this at least one drop being preceded by an ink segment and followed by another ink segment.

13. The continuous inkjet printer according to claim 12, said controller being programmed to apply 3 or more successive cut-offs to a jet, for creating a series of at least 2 drops, this series of drops being preceded by an ink segment and followed by another ink segment.

14. The continuous inkjet printer according to claim 12, said controller being programmed to form ink segments, preceding or following said drops, having a length of, at least, between 400 μm and 1200 μm.

15. A method for forming at least one individual drop using the multi-jet printing head according to claim 10, wherein:

at least 2 successive cut-offs are applied to a jet, thus creating at least one drop isolated from the rest of the jet, this at least one drop being preceded by an ink segment and followed by another ink segment;

or at least 3 or more successive cut-offs are applied to a jet, thus creating a series of at least 2 drops, this series of drops being preceded by an ink segment and followed by another ink segment.

16. The method according to claim 15, said ink segments, preceding or following said at least one drop, or said series of at least 2 drops, having a length of, at least, between 400 μm and 1200 μm.

17. The method according to claim 15, wherein:

at least one jet having a cut-off frequency ($F_c$) higher than the resonant frequency $f_r$ of the corresponding cavity is produced, at least one activation signal, the spectrum of which includes at least said resonant frequency $f_r$, is applied to the actuator.

18. A drop generator for a printing head of a continuous inkjet printer, including:

at least one ink feed conduit for feeding ink into a stimulation chamber, which has a quality factor Q lower than 2 for at least one resonant frequency $f_r$, wherein the quality factor is a ratio of the resonant frequency $f_r$, to a full width half maximum of a frequency peak of the resonant frequency $f_r$, a stimulator for stimulating a wall of said stimulation chamber; and at least one nozzle for ejecting a jet.

19. The drop generator according to claim 18, including a layer which dampens the oscillations of the stimulator transmitted to the cavity.

20. The drop generator according to claim 19, said stimulator being able to apply to said stimulation chamber stimulation signals separated by a time duration between 5 μs and 40 μs.

* * * * *